US007766731B2

(12) United States Patent
Aschenbruck et al.

(10) Patent No.: US 7,766,731 B2
(45) Date of Patent: Aug. 3, 2010

(54) EXHAUST GAS CHIMNEY

(75) Inventors: Emil Aschenbruck, Duisburg (DE); Markus Beukenberg, Mühlheim (DE); Gerhard Fruechtel, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 286 days.

(21) Appl. No.: 11/634,299

(22) Filed: Dec. 5, 2006

(65) Prior Publication Data

US 2007/0137638 A1 Jun. 21, 2007

(30) Foreign Application Priority Data

Dec. 5, 2005 (DE) ..... 10 2005 058 163

(51) Int. Cl.
*F23J 13/02* (2006.01)
*E04F 17/02* (2006.01)
*F23J 11/00* (2006.01)

(52) U.S. Cl. ..... 454/1; 454/44; 126/307 R; 126/312; 110/184

(58) Field of Classification Search ..... 454/44, 454/45, 46, 47, 1; 126/307 R, 312; 110/184
See application file for complete search history.

(56) References Cited

U.S. PATENT DOCUMENTS 1,349,732 A * 8/1920 Pemberton-Billing ..... 126/4
1,497,345 A * 6/1924 Pasichnik ..... 126/58
1,724,683 A * 8/1929 Scarborough ..... 126/73
2,272,428 A * 2/1942 Pedersen ..... 237/70
2,303,503 A * 12/1942 Rugg ..... 285/302
2,680,402 A * 6/1954 Adelt ..... 454/13
3,190,281 A * 6/1965 Northwood ..... 126/518
3,346,042 A * 10/1967 Seehausen ..... 165/154
3,478,674 A * 11/1969 Medeiros ..... 99/347
3,669,042 A * 6/1972 Lawrence ..... 110/184
4,170,856 A * 10/1979 Musser ..... 52/598
4,526,319 A * 7/1985 Toth ..... 237/50
4,608,944 A * 9/1986 Karna ..... 122/4 D
4,685,703 A * 8/1987 Brock ..... 285/47
4,740,357 A * 4/1988 Buswell et al. ..... 422/197
5,506,376 A * 4/1996 Godel ..... 181/208
5,658,024 A * 8/1997 Bachmann et al. ..... 285/299

FOREIGN PATENT DOCUMENTS

JP 54110801 A * 8/1979
JP 58203313 A * 11/1983
JP 07293277 A * 11/1995

* cited by examiner

*Primary Examiner*—Steven B McAllister
*Assistant Examiner*—Patrick F. O'Reilly, III
(74) *Attorney, Agent, or Firm*—Cohen Pontani Lieberman & Pavane LLP

(57) ABSTRACT

An exhaust gas chimney, especially an exhaust gas chimney installed directly downstream of a gas turbine or downstream of the waste heat recovery boiler of a gas turbine, includes an inner shell formed as a metal tube and surrounded by a sound absorption ring filled with bulk material for sound absorption. The sound absorption ring is formed as a ring jacket provided with a lower end plate that slopes downward and is permanently joined with the inner shell of the chimney, and with an upper end plate that slopes upward toward the inner shell. Ribs are joined to the inner shell of the chimney inside the annular jacket.

9 Claims, 2 Drawing Sheets

EXHAUST GAS CHIMNEY

BACKGROUND OF THE INVENTION

1. Field of the Invention

The invention concerns an exhaust gas chimney with an inner shell in the form of a metal tube, especially an exhaust gas chimney installed directly downstream of a gas turbine or downstream of a waste heat recovery boiler of a gas turbine, wherein the inner tube is surrounded by a sound absorption ring which is joined to the inner shell and filled with bulk material.

2. Description of the Related Art

Furnaces in the broad sense carry their combustion gases into the atmosphere through an exhaust gas chimney. Mainly thin-walled metal tubes are used as inner shells of chimneys in the industrial sector. To reduce the sound emissions that are produced by the upstream combustion process, external insulation for the exhaust gas chimneys is often used, and sound absorption elements are often used on the inside of the exhaust gas chimneys or their feed lines.

With increased demands for noise reduction, the mufflers installed in the gas stream are no longer adequate, and additional damping of the chimney body is required. To this end, the inner shell of the chimney is surrounded with a sound absorption ring filled with bulk material to achieve sound decoupling and sound damping of the chimney body. Bulk material damping rings of this type were previously welded directly on the chimney as closed rings with a rectangular cross section.

The inner shell of the chimney is heated relatively quickly by the exhaust gases. If reinforcing or sound-absorbing material accumulations on the chimney structure are necessary, delayed heating occurs, which can lead to very high thermal stresses, depending on the rate of temperature increase. For example, exhaust gas chimneys for gas turbine installations can be influenced to only a very limited extent with respect to temperature control and, in addition, have a high temperature level. In this regard, there have been incidents of damage to chimney systems due to excessively high thermal stress.

SUMMARY OF THE INVENTION

An object of the invention is to design an exhaust gas chimney so that abrupt temperature increases in the inner shell of the chimney are avoided and hindrances to expansion of the inner shell of the chimney are virtually prevented or at least greatly reduced.

In accordance with the invention, the sound absorption ring is formed as a jacket having a cylindrical part spaced from the inner shell, a lower end plate inclined obliquely downward from the cylindrical part toward the inner shell and joined to the inner shell, and an upper end plate inclined obliquely upward from the cylindrical part toward the inner shell. A plurality of ribs are joined to the inner shell inside the ring jacket and extend toward the ring jacket, each rib having an outer edge spaced from the jacket.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The drawings show only the inner shell 1 of an exhaust gas chimney, which is installed, for example, directly downstream of a gas turbine or downstream of the waste heat recovery boiler of a gas turbine installation. The inner shell 1 of the chimney consists of a metal tube, which is surrounded by an outer jacket (not shown). Rings 2, which reinforce the inner shell 1 of the chimney, are mounted around the inner shell 1.

Figure 1:
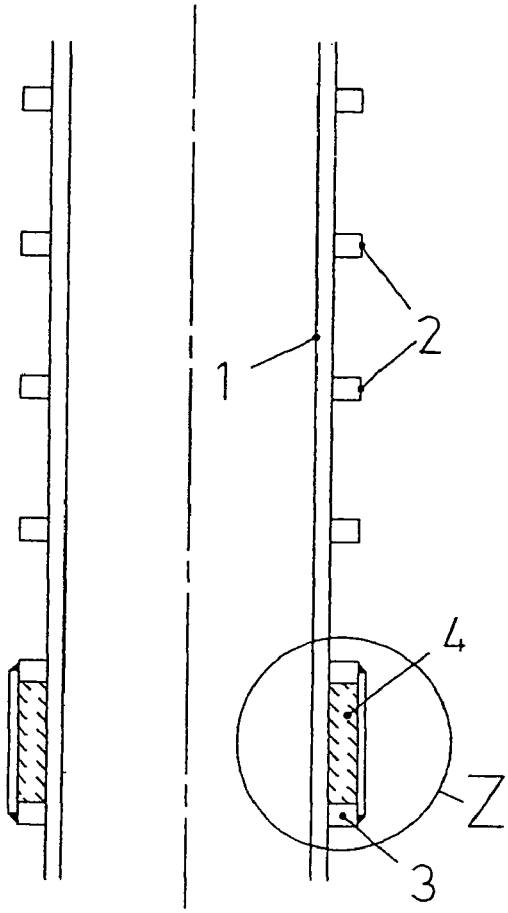
Fig 1 PRIOR ART
FIG. 1 shows a side view of a prior-art exhaust gas chimney.

The lower part of the inner shell 1 of the chimney is surrounded by a sound absorption ring 3 for the absorption of sounds that come from the units upstream of the chimney. The sound absorption ring 3 in accordance with the prior art (FIG. 1) consists of a closed ring which has a rectangular cross section and is welded directly onto the inner shell 1 of the chimney. The sound absorption ring 3 is filled with sand or other bulk material 4.

Figure 2:
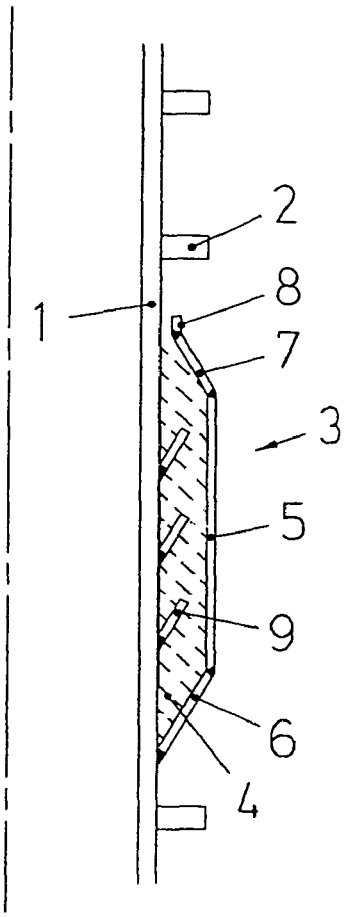
FIGS. 2 to 5 show the detail Z according to FIG. 1 for various embodiments of the invention.

The first variant of the invention, which is illustrated in FIG. 2, also has a sound absorption ring 3 filled with bulk material 4. The sound absorption ring 3 is formed as a ring jacket 5 that fully encircles the inner shell 1 and is made of thin-walled sheet metal. The wall thickness of the jacket 5 is at most half the wall thickness of the inner shell 1 of the chimney. A ring jacket 5 of this type is relatively flexible.

The lower end of the ring jacket 5 is inclined obliquely downward to form a lower, inclined end plate 6, which is permanently joined with the inner shell 1 of the chimney. The inclination of the end plate 6 from the vertical corresponds to an angular range of about 15° to 60°, and preferably an angle of about 30°, between the inside surface of the end plate 6 and the outside surface of the inner shell 1 of the chimney. Due to the inclined end plate 6, elasticity in the joint is preserved, and abrupt temperature differences between the inner shell 1 of the chimney and the ring jacket 5 are avoided.

The upper end of the ring jacket is inclined obliquely upward to form an upper, inclined end plate 7. The angular range between the inside surface of the end plate 7 and the outside surface of the inner shell 1 of the chimney is about 15° to 60°, and preferably about 30°. The upper end plate 7 of the jacket 5 is not joined with the inner shell 1 of the chimney, so that a space is formed between the upper edge 8 of the upper end plate 7 and the inner shell 1 of the chimney. This measure prevents the hindrance of axial expansion and prevents abrupt temperature differences. In addition, internal pressure cannot build up inside the jacket 5, since the jacket 5 is open towards the top.

Obliquely upwardly directed ribs 9 are welded onto the inner shell 1 of the chimney inside the ring jacket 5. The ribs 9 end some distance from the wall of the cylindrical part of the jacket 5. The ribs 9 ensure better heat transfer from the inner shell 1 of the chimney to the bulk material 4 and thus a shorter heating time of the bulk material 4. In addition, the inclination of the ribs 9 makes it possible to fill the space within the jacket 5 with the bulk material 4 easily and completely, and joint stresses are significantly reduced compared to a right-angled arrangement. These ribs are preferably not installed as closed rings.

Figure 3:
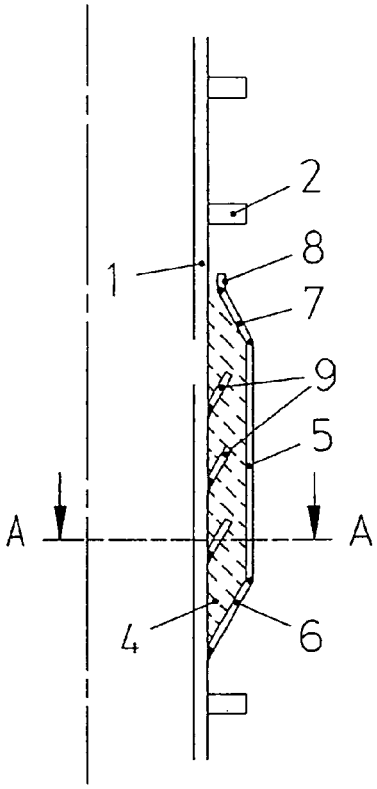
Figure 3A:
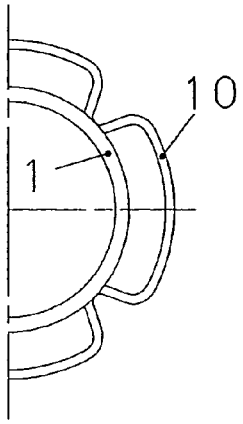
FIG. 3A shows the section A-A according to FIG. 3.

The second variant of the invention, which is illustrated in FIG. 3, is largely the same as the first variant according to FIG. 2. However, the jacket 5 is not a ring that fully encircles the inner shell 1, but rather it is composed of segments 10 (FIG. 3A). This makes it possible also to reduce the tangential stresses on the inner shell 1 of the chimney.

Figure 4:
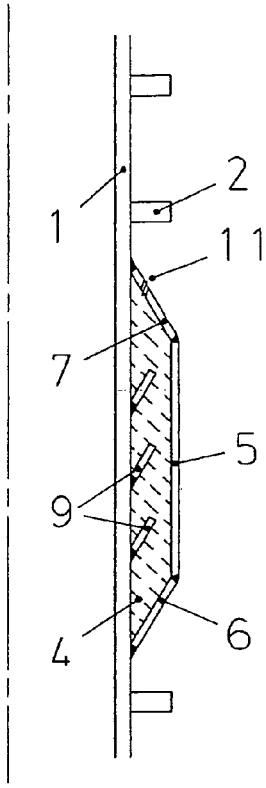

The third variant of the invention, which is illustrated in FIG. 4, is largely the same as the first variant according to FIG. 2. However, the upper inclined end plate 7 is permanently joined with the inner shell 1 of the chimney. It is advantageous to provide vent holes 11 in the upper end plate 7. This is intended to reduce the risk of internal pressure developing in the space inside the ring jacket 5 and the risk of dirt getting into the bulk material filling.

Figure 5:
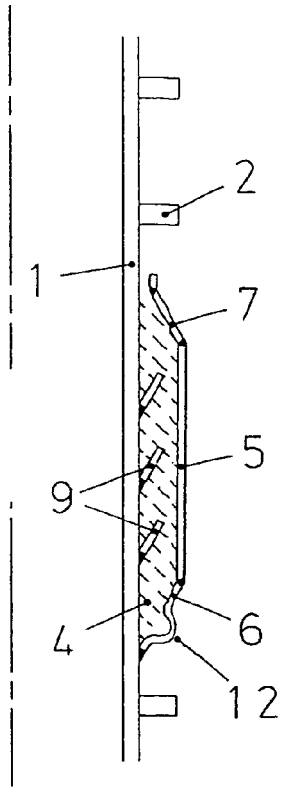

The fourth variant of the invention, which is illustrated in FIG. 5, is also largely the same as the first variant according to FIG. 2. However, a flexible element 12 that acts as a compensator is additionally provided in the lower end plate 6. Stresses caused by temperature differences in the region of the lower joint are further reduced by the flexible element 12.

Due to the design of the ring jacket 5, the invention can be used in all metal chimney systems with stringent requirements for low sound emissions and fast rates of chimney heating, as are typically made in connection with gas turbines.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An exhaust gas chimney comprising:

an inner shell in the form of a metal tube through which exhaust gas passes;

a ring jacket surrounding the metal shell and forming a space between the ring jacket and the inner shell, the ring jacket comprising a cylindrical part spaced from the inner shell, a lower end plate inclined obliquely downward from the cylindrical part to the inner shell and joined directly to the inner shell, and an upper end plate inclined obliquely upward from the cylindrical part toward the inner shell;

a plurality of ribs joined to the inner shell inside the ring jacket and extending radially outward and upward toward the ring jacket at an acute angle as measured from between the inner surface of each said rib to the outer surface of the inner shell, each said rib having a radially outer edge spaced from the jacket; and a bulk material in the space between the ring jacket and the inner shell;

wherein the upper end plate is one of:

(i) joined to said inner shell and provided with vent holes; or (ii) provided with an upper edge which is spaced from the inner shell, whereby the ring jacket is open.

2. The exhaust gas chimney of claim 1 wherein the upper end plate has an upper edge which is spaced from the inner shell, whereby the ring jacket is open.

3. The exhaust gas chimney of claim 1 wherein said lower end plate comprises a flexible joint.

4. The exhaust gas chimney of claim 1 wherein said ring jacket comprises segments which are circumferentially spaced.

5. The exhaust gas chimney of claim 4 wherein said upper end plate is joined to said inner shell and provided with vent holes.

6. The exhaust gas chimney of claim 1 wherein the inner shell has a wall thickness, and the ring jacket has a wall thickness which is at most half the wall thickness of the inner shell.

7. The exhaust gas chimney of claim 1 wherein the lower end plate is downwardly inclined from the cylindrical part toward the inner shell at an angle of about 15° to 60°.

8. The exhaust gas chimney of claim 7 wherein the lower end plate joins the inner shell at an angle of about 15° to 60° as measured from between the inner surface of the lower end plate to the outer surface of the inner shell.

9. The exhaust gas chimney of claim 1 wherein the upper end plate is upwardly inclined from the cylindrical part toward the inner shell at an angle of about 15° tol 60°.

* * * * *